US008616164B2

(12) United States Patent
Kunert et al.

(10) Patent No.: US 8,616,164 B2
(45) Date of Patent: Dec. 31, 2013

(54) INTERNAL COMBUSTION ENGINE AND METHOD OF OPERATING THE SAME

(75) Inventors: Niels Kunert, Ottenbach (DE); Werner Geyer, Berglen (DE); Markus Maurer, Forst (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 1508 days.

(21) Appl. No.: 12/155,165

(22) Filed: May 30, 2008

(65) Prior Publication Data

US 2008/0302344 A1 Dec. 11, 2008

(30) Foreign Application Priority Data

Jun. 5, 2007 (DE) ..... 10 2007 026 121

(51) Int. Cl.
*F02B 33/04* (2006.01)
*F02B 25/00* (2006.01)

(52) U.S. Cl.
USPC ..... 123/73 PP; 123/73 AA; 123/61 V; 123/69 V; 123/193.6; 123/433

(58) Field of Classification Search
USPC ..... 123/73 PP, 65 PP, 65 P, 73 A, 73 FA, 123/193.6, 73 R, 73 C, 65 A, 67, 58.4, 73 CC, 123/74 A, 71 R, 73 V, 73 F, 41.72, 196 R, 123/61 V, 69 V, 73 AA, 193.1, 433
See application file for complete search history.

(56) References Cited

U.S. PATENT DOCUMENTS 7,082,910 B2 8/2006 Carlsson et al.
8,065,981 B2 * 11/2011 Ishida ..... 123/73 AA
2003/0217711 A1 * 11/2003 Geyer et al. ..... 123/73 PP

* cited by examiner

*Primary Examiner* — Lindsay Low
*Assistant Examiner* — Kevin Lathers
(74) *Attorney, Agent, or Firm* — Walter Ottesen P.A.

(57) ABSTRACT

An internal combustion engine has a cylinder (2) wherein a combustion chamber (3) is formed which is delimited by a piston (5) journalled to move back and forth. At least one transfer channel (14) is provided which connects the crankcase (4) of the engine to the combustion chamber (3) in at least one position of the piston (5). The engine has a supply channel (13) which opens with a supply channel inlet (11) at the cylinder bore (34). The supply channel (13) is connected to the transfer channel (14) via at least one piston pocket (22, 42) in at least one position of the piston (5). In order to achieve low exhaust-gas values of the engine, the piston pocket (22, 42) has a distance (a) to a lower edge (27) of the transfer window (15) which is less than the distance (b) to a lower edge (26) of the inlet (11) of the supply channel at bottom dead center of the piston (5). A method for operating an engine provides that the piston pocket (22, 42) is first connected to the transfer window (15) and then to the supply channel inlet (11) during the upward stroke of the piston (5).

17 Claims, 3 Drawing Sheets

INTERNAL COMBUSTION ENGINE AND METHOD OF OPERATING THE SAME

CROSS REFERENCE TO RELATED APPLICATION

This application claims priority of German patent application no. 10 2007 026 121.9, filed Jun. 5, 2007, the entire content of which is incorporated herein by reference.

BACKGROUND OF THE INVENTION

U.S. Pat. No. 7,082,910 discloses an internal combustion engine, namely, a two-stroke engine, which has a channel for supplying a mixture as well as a separate channel for supplying air. The air channel opens at the cylinder bore and is connected to a transfer channel in the region of top dead center of the piston. Scavenging advance air is stored in advance in the transfer channel.

It has been shown that in scavenging advance engines of this kind, the scavenging of the combustion chamber does not take place only with pure air but that the mixture can also reach the combustion chamber during the scavenging operation which then escapes through the outlet. This situation deteriorates the exhaust-gas values of the internal combustion engine.

SUMMARY OF THE INVENTION

It is an object of the invention to provide an internal combustion engine of the kind described above which exhibits improved exhaust-gas values. A further object of the invention is to provide a method for operating an internal combustion engine with which low exhaust-gas values can be obtained.

The internal combustion engine of the invention includes: a cylinder having a cylinder bore defining a combustion chamber and a cylinder longitudinal axis; a crankcase connected to the cylinder; a crankshaft rotatably journalled in the crankcase; a piston disposed in the cylinder bore so as to move back and forth therein to drive the crankshaft in rotation and to delimit the combustion chamber; at least one transfer channel for connecting the crankcase to the combustion chamber in at least one position of the piston; the transfer channel having a predetermined length and a transfer window opening into the combustion chamber; the transfer channel being separated from the interior space of the cylinder bore over a portion of the length of the transfer channel; a supply channel having an inlet opening at the cylinder bore; the piston having at least one piston pocket connecting the supply channel to the transfer channel in at least one position of the piston; the transfer window having a lower edge and the inlet having a lower edge; the piston pocket being at a first distance (a, a') from the lower edge of the transfer window measured parallel to the longitudinal axis of the cylinder when the piston is at bottom dead center and being at a second distance (b, b') from the lower edge of the inlet measured parallel to the longitudinal axis; and, the first distance (a, a') being less than the second distance.

It has been shown that a portion of the scavenging losses in an engine of this kind are based on the fact that an air/fuel mixture flows out from the transfer channel into the piston pocket during the downward stroke of the piston. This mixture can enter into the supply channel, which supplies substantially fuel-free combustion air, and leads to a contamination of the supply channel with fuel. During the upward stroke of the piston, this fuel is drawn by suction together with the scavenging advance air into the transfer channel. In this way, the scavenging advance air, which is stored in advance in the transfer channel, likewise contains fuel.

It has been shown that this contamination of the supply channel with fuel can be reduced and substantially avoided in that the piston pocket has a distance to the lower edge of the transfer window measured parallel to the cylinder longitudinal axis which is less than the distance to a lower edge of the supply channel inlet measured parallel to the cylindrical longitudinal axis. With this configuration of the internal combustion engine, the piston pocket is first connected to the transfer channel during the upward stroke of the piston. An air/fuel mixture, which has reached the piston pocket during the downward stroke of the piston, can therefore be drawn by suction into the crankcase via the transfer channel during an upward stroke of the piston with which an underpressure arises in the crankcase. In this way, an inflow of an air/fuel mixture into the supply channel is substantially prevented. The scavenging advance air, which is supplied via the supply channel, is substantially fuel-free and not contaminated by an air/fuel mixture from the piston pocket. In this way, the combustion chamber can be scavenged with substantially fuel-free air/fuel mixture. The scavenging losses are reduced and the exhaust-gas values of the internal combustion engine are improved.

The distance is always the shortest distance between the particular lower edge and the piston pocket. The distance indicates which stroke the piston must pass through until the transfer window or the supply channel is connected to the piston pocket. Here, the shortest distance, which is measured parallel to the cylinder longitudinal axis, is decisive.

Advantageously, the difference between the distance of the piston pocket to the lower edge of the supply channel inlet and the distance of the piston pocket to the lower edge of the transfer window is 5% to 50% of the piston stroke. Advantageously, the difference is 20% to 35% of the piston stroke. In this way, it is ensured that the piston pocket is connected to the transfer channel for a sufficiently long time before the piston pocket opens to the supply channel. In this way, the mixture from the piston pocket can substantially flow into the transfer channel before the supply channel opens to the piston pocket.

In the region wherein the transfer window is passed over during the stroke of the piston, it is provided that the piston pocket has a longer axial length than in the region wherein the supply channel inlet is passed over during the stroke of the piston. In this way, the transfer channel is opened longer to the piston pocket than the supply channel.

Advantageously, the transfer window and the supply channel inlet are at a distance from each other in the peripheral direction of the cylinder. The transfer window and the supply channel inlet have no overlapment in the peripheral direction of the cylinder. In this way, the supply channel inlet and the transfer window are controlled by different regions of the piston periphery. In this way, different control times can be realized for the connection of the channels to the piston pocket. This is not possible in an internal combustion engine wherein a transfer window overlaps a supply channel inlet in the peripheral direction of the cylinder because the transfer window must be arranged on the side of the supply channel facing toward the combustion chamber.

In order to achieve the least possible elevation of the internal combustion engine, it is provided that the transfer window and the supply channel inlet overlap each other in the direction of the longitudinal axis of the cylinder. It is especially provided that the upper end of the piston, which delimits the combustion chamber, is configured to be planar and extends perpendicularly to the longitudinal axis of the cylinder. The overlapment advantageously is less than 5% of the piston stroke.

The internal combustion engine is especially a mixture-lubricated internal combustion engine which has a device for supplying fuel into the crankcase. In mixture-lubricated internal combustion engines, an air/fuel mixture from the crankcase enters into the combustion chamber via the transfer channels. Here, an advance storage of air in the transfer channels is practical in order to reduce exhaust-gas values. Advantageously, the cylinder has an outlet out of the combustion chamber and a center plane which contains the longitudinal axis of the cylinder and partitions the outlet. Advantageously, one transfer channel is arranged on each side of the center plane. The internal combustion chamber thereby has a total of two transfer channels which are advantageously arranged symmetrically to the center plane. It is provided that a supply channel inlet opens at the cylinder bore on each side of the center plane and that the supply channel is subdivided into two branches which each open at a supply channel inlet. Each transfer channel is supplied with scavenging advance air from a branch of the supply channel. For this reason, a good and complete scavenging of the transfer channels is achieved. A simple constructive configuration results because of the division of a supply channel into two branches.

Advantageously, the piston has a piston pin eye. The piston pin eye lies especially outside of the piston pocket. In this way, good flow conditions in the piston pocket result. The volume of the piston pocket can then be comparatively small.

The method of the invention is for operating an internal. combustion engine and the engine includes: a cylinder having a cylinder bore defining a combustion chamber and a cylinder longitudinal axis; a crankcase connected to the cylinder; a crankshaft rotatably journalled in the crankcase; a piston disposed in the cylinder bore so as to move back and forth therein to drive the crankshaft in rotation and to delimit the combustion chamber; at least one transfer channel for connecting the crankcase to the combustion chamber in at least one position of the piston; the transfer channel having a predetermined length and a transfer window opening into the combustion chamber; the transfer channel being separated from the interior space of the cylinder bore over a portion of the length of the transfer channel; a supply channel having an inlet opening at the cylinder bore; and, the piston having at least one piston pocket connecting the supply channel to the transfer channel in at least one position of the piston; the method comprising the step of: during an upward stroke of the piston, causing the piston pocket to be first connected to the transfer window and then be connected to the inlet of the supply channel.

Because the piston pocket is at first connected via the transfer channel to the crankcase and an air/fuel mixture is drawn by suction from the piston pocket into the crankcase, and because with the further upward stroke of the piston, the piston pocket is connected to the supply channel, the combustion air (especially substantially fuel-free combustion air) is drawn by suction from the supply channel via the piston pocket into the transfer channel and into the crankcase. Because the air/fuel mixture was drawn from the piston pocket essentially into the transfer channel, a contamination of the supply channel with fuel from the piston pocket does not result. The pressure present in the piston pocket could already drop because of the opening of the piston pocket to the transfer channel. Only a low pressure is present in the piston pocket so that a back flow of the air/fuel mixture from the piston pocket into the supply channel does not take place. In this way, low exhaust-gas values of the internal combustion engine result.

Advantageously, the supply channel inlet is connected to the piston pocket by 10° crankshaft angle to 50° crankshaft angle later than the transfer window. Combustion air is drawn by suction from the supply channel via the piston pocket into the transfer channel after the connection of the supply channel inlet is made with the piston pocket. The combustion air drawn by suction from the supply channel serves as scavenging advance air in the transfer channel. During the downward stroke of the piston, this scavenging advance air separates the exhaust gases from the after-flowing fresh mixture from the crankcase during entry into the combustion chamber. This prevents fresh mixture from the crankcase passing directly into the outlet.

Advantageously, the transfer window is open longer than the supply channel inlet during the upward stroke of the piston. Especially, an air/fuel mixture is supplied to the internal combustion engine into the crankcase. For a mixture-lubricated internal combustion engine of this kind, a separation of the air/fuel mixture from the exhaust gases in the combustion chamber by the scavenging advance air is advantageous. The air/fuel mixture flows into the combustion chamber from the crankcase.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
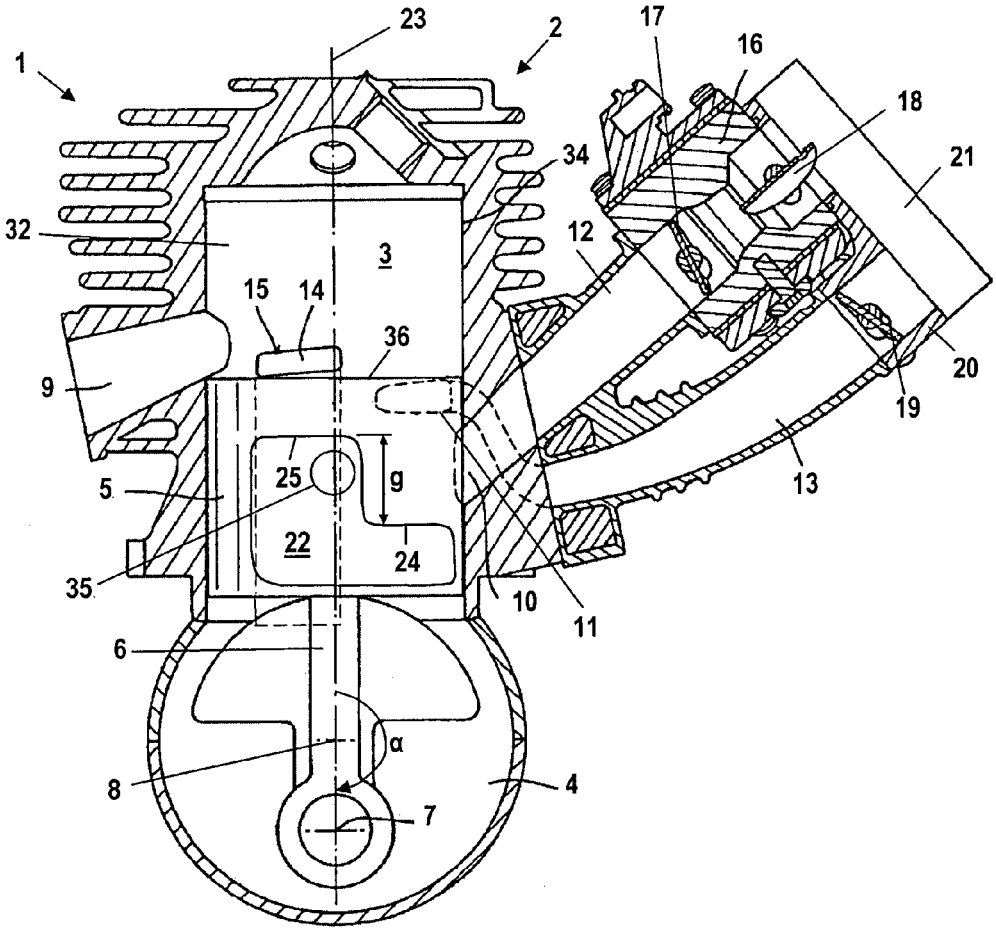
FIG. 1 is a schematic showing a longitudinal section of an internal combustion engine.

The internal combustion engine shown in FIG. 1 is a mixture-lubricated two-stroke engine 1. The two-stroke engine 1 is especially used to drive the work tool of a handheld work apparatus such as a motor-driven chain saw, cutoff machine, brushcutter or the like. The two-stroke engine 1 has a cylinder 2 defining a cylinder bore 34 delimiting a combustion chamber 3. The combustion chamber 3 is arranged in the interior space 32 of the cylinder 2. An outlet 9 leads out of the combustion chamber 3. A piston 5 is journalled in the cylinder 2 to move back and forth and the upper end 36 of the piston delimits the combustion chamber 3. The upper end 36 of the piston is planar and is configured to be perpendicular to a longitudinal axis 23 of the cylinder. The piston 5 drives a crankshaft 7 via a connecting rod 6 with the crankshaft being rotatably journalled in a crankcase 4. The crankshaft 7 is rotatably driven about a rotational axis 8. In FIG. 1, the piston is shown at bottom dead center. This corresponds to a crankshaft angle ($\alpha$) of 180°.

The two-stroke engine 1 has a carburetor 16 as a fuel supply unit. The carburetor 16 is connected via a mixture channel 12 to the two-stroke engine 1 and opens via a mixture inlet 10 into the crankcase 4. The mixture inlet 10 is slot controlled by the piston 5. In the carburetor 16, a throttle flap 17 and a choke flap 18 are pivotally journalled with the choke flap 18 being disposed upstream of the throttle flap 17. The carburetor 16 is connected to an air filter 21 via which combustion air is inducted.

The two-stroke engine 1 has a supply channel 13 for supplying fuel-poor or substantially fuel-free combustion air. The supply channel 13 opens with a supply channel inlet 11 at the cylinder bore 34. As shown in the section view of FIG. 2, the supply channel 13 divides into two branches (13', 13") in the region of the cylinder 2. The two branches (13', 13") open with respective supply channel inlets 11 at the cylinder bore 34.

A supply channel section 20 is held on the carburetor 16 wherein a control flap 19 is pivotally journalled. The control flap 19 controls the combustion air quantity supplied via the supply channel 13. The position of the control flap 19 is advantageously coupled to the position of the throttle flap 17 in the mixture channel.

Figure 2:
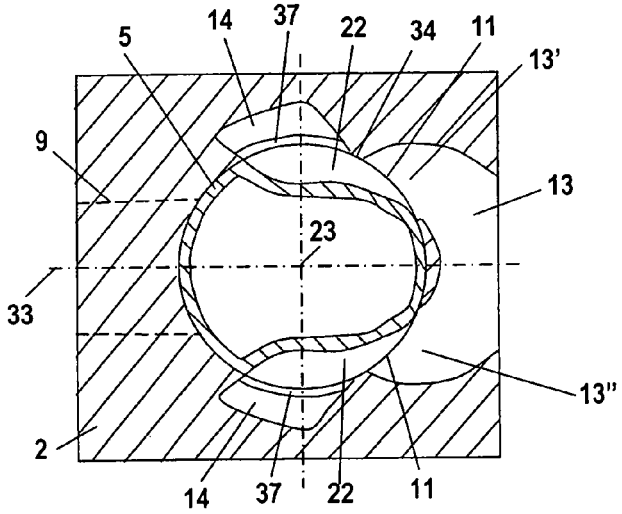
FIG. 2 is a schematic section view of the internal combustion engine of FIG. 1.

As FIGS. 1 and 2 show, the two-stroke engine 1 has two transfer channels 14 which connect the crankcase 4 to the combustion chamber 3 in the region of bottom dead center of the piston 5 shown in FIG. 1. The transfer channels 14 open with transfer windows 15 into the combustion chamber 3 and these transfer windows are slot controlled by the piston 5. The transfer channels 14 are separated between the transfer windows 15 and their openings into the crankcase 4 by the wall sections 37 shown in FIG. 2.

The piston 5 has a piston pocket 22 which connects the supply channel inlet 11 to the transfer window 15 in the region of top dead center of the piston 5. As shown in FIG. 2, the two-stroke engine 1 has a center plane 33. The center plane 33 partitions the outlet 9 at the center and contains the longitudinal axis 23 of the cylinder. The two transfer channels 14 are arranged symmetrically to the center plane 33. Correspondingly, the piston 5 has two piston pockets 22 arranged symmetrically to the center plane 33. The piston pockets 22 define a connection between the respective branches (13', 13") of the supply channel 13 and the transfer windows 15 of the transfer channels 14. The piston 5 has a piston pin eye 35 for connecting to the connecting rod 6. The piston pin eye 35 is arranged in the piston pocket 22 in the embodiment of FIG. 1.

The supply channel inlet 11 is closed by the piston 5 at bottom dead center of the piston 5 shown in FIG. 1. The transfer window 15 is opened to the combustion chamber 3. The piston pocket 22 has a control edge 25 in the region where the transfer window 15 is passed over with the up and down movement of the piston 5. The control edge 25 is the upper edge of the piston pocket 22 in this region, that is, the edge facing toward the combustion chamber 3. In the region in which the supply channel inlet 11 is passed over by the back and forth movement of the piston 5, the piston pocket 22 has a control edge 24 which likewise defines the upper edge of the piston pocket 22 in this region. The two control edges 24 and 25 have a spacing (g) measured parallel to the longitudinal axis 23 of the cylinder. The control edge 24 is arranged closer to the crankcase 4 and the control edge 25 is arranged closer to the combustion chamber 3.

Figure 3:
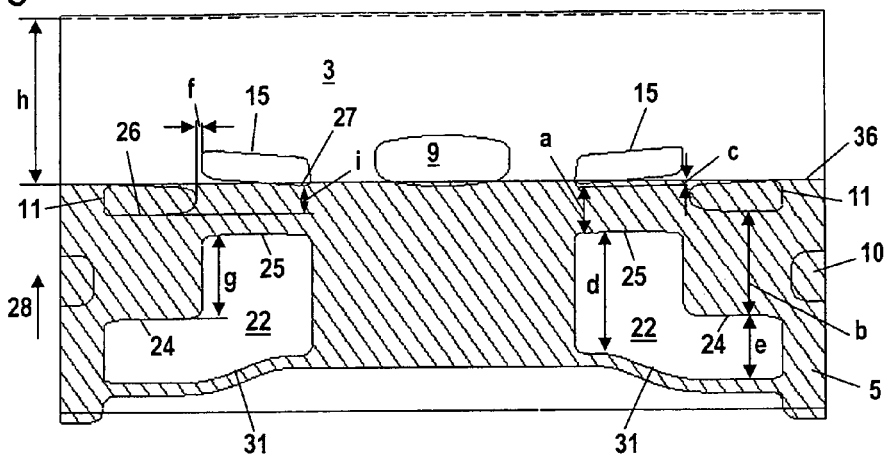
FIGS. 3 to 8 show the interaction of the piston and the cylinder of FIGS. 1 and 2 in different positions of the piston; and, FIG. 9 shows an interaction of an embodiment of a piston.

The operation of the two-stroke engine 1 is explained in the following with respect to FIG. 1 in combination with FIGS. 3 to 8. In FIG. 3, the piston 5 is shown at bottom dead center as in FIG. 1. The outlet 9 out of the combustion chamber 3 is substantially opened by the piston 5. The two transfer windows 15 are also open to the combustion chamber 3. The transfer windows 15 have a lower edge 27 facing toward the crankcase 4. The lower edge 27 is at a distance (a) to the control edge 25 at bottom dead center of the piston 5.

The supply channel inlet 11 has a bottom edge 26 which lies facing toward the crankcase 4 and is at a distance (b) to the control edge 24. As shown in FIG. 3, the distance (a) is considerably less than the distance (b). The difference between the distances (a) and (b) advantageously amounts to 5% to 50% of the piston stroke (h). The difference of the distances (a) and (b) amounts advantageously to 20% to 35% of the piston stroke (h). The piston stroke (h) is the distance of the piston upper end 36 at bottom dead center shown in FIG. 3 to the piston upper end 36 at top dead center of the piston 5 shown in FIG. 8. The position of the piston upper end 36 at top dead center is shown in phantom outline in FIG. 3. The distances indicate the smallest distance, which is measured parallel to the longitudinal axis 23 of the cylinder, that is, the distance which is decisive for the control times.

The supply channel inlet 11 has an upper edge 30 which lies facing toward the combustion chamber 3 and which is arranged above the lower edge 27 of the transfer window 15. The supply channel inlet 11 and the transfer window 15 therefore have an overlapment (c). The lower edge 27 of the transfer channel 15 then lies closer to the crankcase than the upper edge 30 of the supply channel inlet 11. The overlapment (c) is slight and advantageously amounts to less than 5% of the piston stroke (h).

As shown in FIG. 3, the supply channel inlet 11 and the transfer window 15 assigned thereto are arranged next to each other when viewed in the peripheral direction of the cylinder. Here, there is no overlapment. A distance (f) is given in the peripheral direction of the cylinder between the supply channel inlet 11 and the transfer window 15. The distance (f) can be short.

Figure 4:
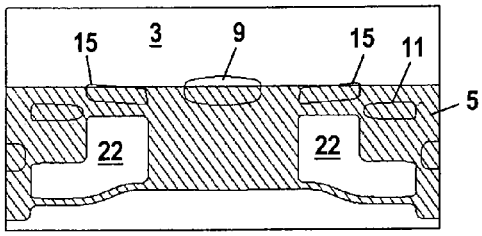

If the piston 5 is moved in the direction of arrow 28 from the position at bottom dead center shown in FIG. 3 toward the combustion chamber 3, the piston 5 therefore executes an upward stroke and first the transfer windows 15 and the outlet 9 are closed. In FIG. 4, the piston 5 is shown closing the transfer windows 15. This takes place, for example, at a crankshaft angle ($\alpha$) of 230° to 240°.

Figure 5:
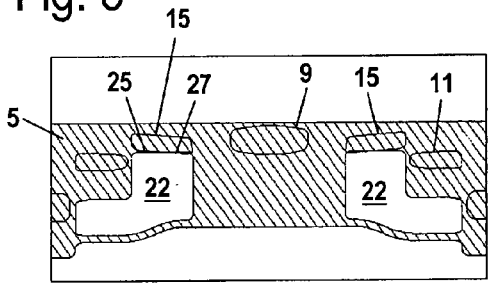

With a further upward stroke, the outlet 9 is likewise fully closed. Thereafter, the control edge 25 comes into overlapment with the lower edge 27 of the transfer window 15 in the region of the transfer window 15. This is shown in FIG. 5. This can, for example, take place at a crankshaft angle ($\alpha$) of 250° to 260°. At this time point, the piston pockets 22 are connected to respective transfer windows 15. An underpressure is present in the crankcase 4 during the upward stroke of the piston 5. Because of this underpressure, an air/fuel mixture is inducted from the piston pockets 22 into the transfer channels 14 and eventually into the crankcase 4 with the connection of the piston pockets 22 to the transfer channels 14. The transfer windows 15 are fully opened with the further upward stroke of the piston 5. The supply channel inlets 11 are at first still closed.

Figure 6:
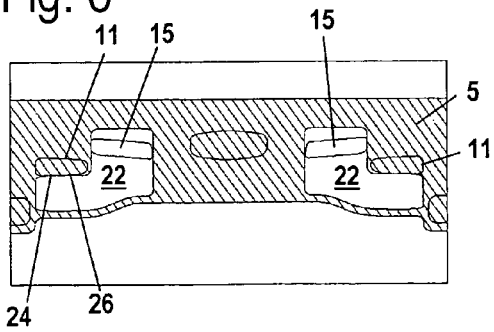

FIG. 6 shows the piston 5 when opening the supply channel inlets 11. In the piston position shown in FIG. 6, for example, at a crankshaft angle ($\alpha$) of 285° to 295°, the control edges 24 come into overlapment with the lower edges 26 of the supply channel inlets 11. In this way, each supply channel inlet 11 is connected to a piston pocket 22. In this way, further fuel-free combustion air can flow from the supply channel 13 via the supply channel inlet 11 into the piston pockets 22 and from there through the transfer windows 15 into the transfer channels 14. The inflow takes place because of the underpressure generated in the crankcase 4 by the upward movement of the piston 5.

Figure 7:
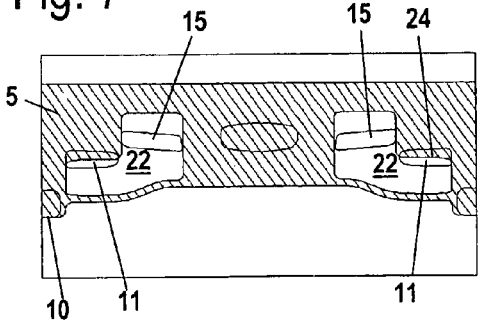

In FIG. 7, the connection between the supply channel inlets 11 and the transfer windows 15 is shown. Furthermore, the mixture inlet 10 opens to the crankcase 4 in the position of the piston 5 shown in FIG. 7. This can take place, for example, at a crankshaft angle (α) of 295° to 305°.

Figure 8:
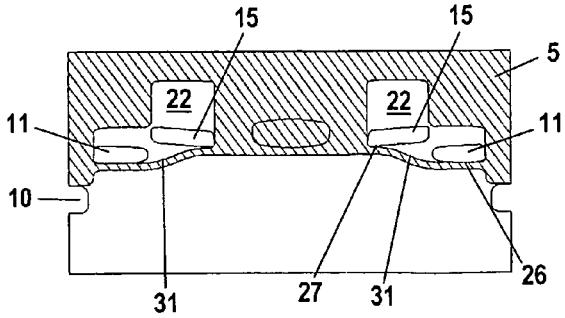

FIG. 8 shows the piston 5 at top dead center. The supply channel inlets 11 and the transfer windows 15 are arranged in the lower region of the piston pockets 22. As shown in FIG. 8, the piston pockets 22 have an incline 31 at their lower end which connects the lower edge 26 of the supply channel inlets 11 to the lower edge 27 of the transfer windows 15 and so effects a good flow guidance.

The mixture inlet 10 is first closed during the downward stroke of the piston 5. Thereafter, the supply channel inlets 11 are closed by the piston skirt of the piston 5. However, an air/fuel mixture can still flow from the transfer channels 14 into the piston pockets 22. Thereafter, the transfer windows 15 are also separated from the piston pockets 22. In this way, an air/fuel mixture is disposed in the piston pockets 22 which is drawn by suction into the transfer channels 14 during the following upward stroke of the piston.

As shown in FIGS. 3 to 8, the transfer windows 15 are connected to the piston pockets 22 longer than the supply channel inlets 11. This results from the different axial lengths of the piston pockets 22 in the region of the transfer windows 15 and the supply channel inlets 11. As shown in FIG. 3, the piston pockets 22 have an axial length (e) in the region which controls a supply channel inlet 11. The piston pockets 22 have an effective axial length (d) in the region whereat the connection to a transfer window 15 is controlled. This axial length (d) is considerably longer than the axial length (e) in the region of the supply channel inlets 11. The effective axial length is the length of the region wherein the assigned window is actually arranged. As shown in FIG. 8, no transfer windows are arranged in the region of the incline 31. The effective axial length is therefore not measured in the region of the incline 31, rather, in the neighboring region whereat the transfer window 15 is actually disposed in the region of top dead center of the piston 5. As shown in FIG. 3, the lower edge 26 of the supply channel inlet 11 is at a distance (e) from the lower edge 27 of the transfer window 15. The lower edge 26 of the supply channel inlet 11 is then disposed closer to the crankcase 4 than the lower edge 27 of the transfer window 15.

Figure 9:
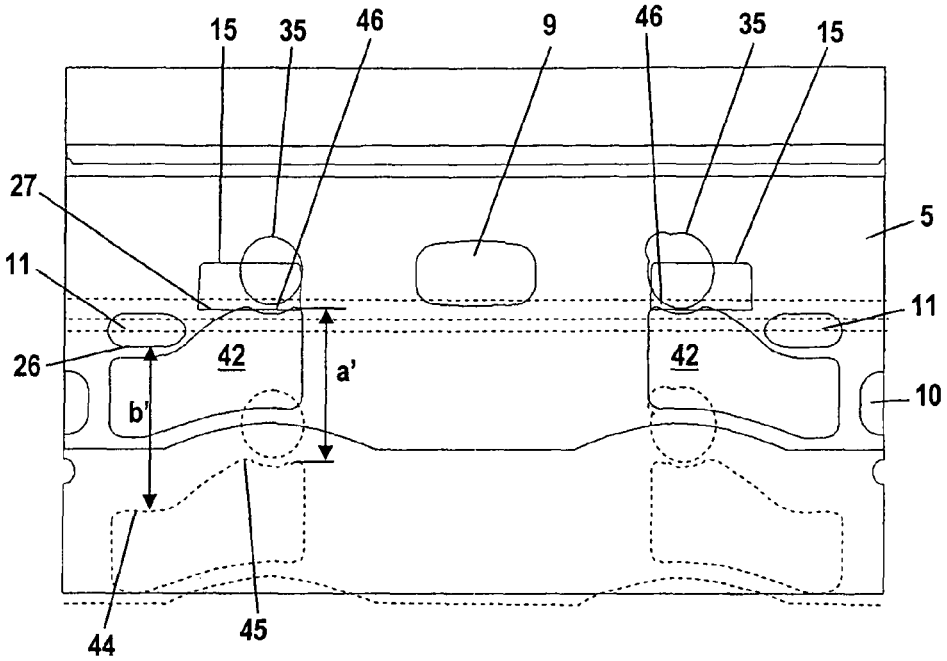

A further embodiment is shown in FIG. 9. The same reference numerals identify like components.

The piston shown in FIG. 9 differs from the piston of FIGS. 1 to 8 essentially by the configuration of the piston pockets 42. In the piston 5 shown in FIG. 9, the piston pin eye 35 is arranged outside and above the piston pockets 42. The piston pin eye 35 is separated from the piston pocket 42 by a strut 46. The piston pin eye 35 is arranged outside of the piston pocket 42 and therefore favorable flow relationships result in the piston pocket 42. The piston pocket 42 can exhibit a good scavengeable contour. Turbulences of flow can be avoided by a corresponding configuration of the piston pocket 42. In the region of bottom dead center shown in phantom outline in FIG. 9, the control edge 45 of the piston pocket 42 has a distance (a') to the lower edge 27 of the transfer window 15 measured parallel to the longitudinal axis 23 of the cylinder. The control edge 45 is the region of the piston pocket 42 which first passes over the lower edge 27 of the transfer window 15 during the upward stroke of the piston 5. The lower edge 26 of the supply channel inlet 11 has an axial distance (b') to the control edge 44 of the piston pocket 42 (that is, to the control edge of the piston pocket 42 which passes over the supply channel inlet 11 with the backward and forward movement of the piston 5) with this axial distance (b') being longer than the distance (a'). As shown in FIG. 9, the distance (b') is only slightly longer than the distance (a'). This means that the piston pocket 42 is opened to the transfer window 15 only a short time before the piston pocket 42 also opens to the supply channel inlet 11.

In FIG. 1, the two-stroke engine 1 has a carburetor and a supply channel 13 completely separated therefrom. In lieu of a separately-guided transfer channel 13, it can, however, be provided that the intake channel is partitioned over at least a section of its length. Especially, a partition in a section of the intake channel is provided for this purpose. It can, however, be provided that the mixture channel 12 and the supply channel 13 open at a common carburetor whose throttle flap controls the mixture channel as well as the supply channel.

It has been shown to be advantageous when the volume of the piston pocket (22, 42) is selected as small as possible. This can especially be achieved when the piston pin eye 35 is arranged outside of the piston pocket 42. In order to obtain a sufficient charge for the transfer channels 14, the piston pocket (22, 42) has a good scavengeable contour which is advantageously optimized for flow.

It is understood that the foregoing description is that of the preferred embodiments of the invention and that various changes and modifications may be made thereto without departing from the spirit and scope of the invention as defined in the appended claims.

What is claimed is:

1. An internal combustion engine comprising:

a cylinder having a cylinder bore defining a combustion chamber and a cylinder longitudinal axis;

a crankcase connected to said cylinder;

a crankshaft rotatably journalled in said crankcase;

a piston disposed in said cylinder bore so as to move back and forth therein through a piston stroke (h) to drive said crankshaft in rotation and to delimit said combustion chamber;

at least one transfer channel for connecting said crankcase to said combustion chamber in at least one position of said piston;

said transfer channel having a predetermined length and a transfer window opening into said combustion chamber;

said transfer channel being separated from the interior space of said cylinder bore over at least a portion of said length of said transfer channel;

a supply channel having an inlet opening at said cylinder bore;

said piston having at least one piston pocket;

said piston pocket being configured to provide a connection for conducting a fluid between said supply channel and said transfer channel in at least one position of said piston;

said transfer window having a lower edge facing toward said crankcase and said inlet opening having a lower edge facing toward said crankcase;

said piston pocket having a first region passing over said transfer window during said stroke (h);

said piston pocket having a first edge facing toward said combustion chamber and said first edge being a first control edge in said first region;

said piston pocket having a second region passing over said inlet opening of said supply channel during said stroke (h);

said piston pocket having a second edge facing toward said combustion chamber and said second edge being a second control edge in said second region;

said first and second regions being fluidly connected to each other;

at bottom dead center of said piston, said first control edge being at a first distance (a, a') to said lower edge of said transfer window measured parallel to said longitudinal axis;

at said bottom dead center, said second control edge being at a second distance (b, b') to said lower edge of said inlet opening of said supply channel measured parallel to said longitudinal axis; and, said first distance (a, a') being less than said second distance (b, b') so as to cause all of said piston pocket to be first connected to said transfer window during said stroke (h) in an upward direction and thereafter to be connected to said inlet opening of said supply channel.

2. The internal combustion engine of claim 1, wherein the difference between said second distance (b, b') and said first distance (a, a') is 5% to 50% of said piston stroke (h).

3. The internal combustion engine of claim 2, wherein said difference is 20% to 35% of said piston stroke (h).

4. The internal combustion engine of claim 1, wherein said piston pocket has a longer axial length (d) in said first region than in said second region.

5. The internal combustion engine of claim 1, wherein said transfer window and said inlet of said supply channel are separated from each other by a distance (f) measured in the peripheral direction of said cylinder.

6. The internal combustion engine of claim.1, wherein said transfer window and said inlet of said supply channel conjointly define an overlapment (c) in the direction of said longitudinal axis of said cylinder.

7. The internal combustion engine of claim 6, wherein said overlapment (c) is less than 5% of said piston stroke (h).

8. The internal combustion engine of claim 1, wherein said internal combustion engine is a mixture-lubricated internal combustion engine having a device for supplying fuel into said crankcase.

9. The internal combustion engine of claim 1, wherein said transfer channel is a first transfer channel and wherein said internal combustion engine has a second transfer channel and an outlet opening from said combustion chamber; said cylinder has a center plane containing said longitudinal axis and said center plane partitions said outlet; and, said first and second transfer channels are disposed on respective sides of said center plane.

10. The internal combustion engine of claim 9, wherein said inlet opening is defined by first and second inlets on respective sides of said center plane opening at said cylinder bore; and, said supply channel is subdivided into two branches opening at corresponding ones of said first and second inlets.

11. The internal combustion engine of claim 1, wherein said piston has a piston pin eye and said piston pin eye lies outside of said piston pocket.

12. A method for operating an internal combustion engine including: a cylinder having a cylinder bore defining a combustion chamber and a cylinder longitudinal axis; a crankcase connected to said cylinder; a crankshaft rotatably journalled in said crankcase; a piston disposed in said cylinder bore so as to move back and forth therein to drive said crankshaft in rotation and to delimit said combustion chamber; at least one transfer channel for connecting said crankcase to said combustion chamber in at least one position of said piston; said transfer channel having a predetermined length and a transfer window opening into said combustion chamber; said transfer channel being separated from the interior space of said cylinder bore over a portion of said length of said transfer channel; a supply channel having an inlet opening at said cylinder bore; and, said piston having at least one piston pocket; said piston pocket being configured to provide a connection between said supply channel and said transfer channel in at least one position of said piston; the method comprising the step of:

during an upward stroke of said piston, causing all of said piston pocket to be first connected to said transfer window and then be connected to said inlet of said supply channel.

13. The method of claim 12, wherein said inlet of said supply channel is connected to said piston pocket later than said transfer window is connected to said piston pocket by a crankshaft angle ($\alpha$) in a range of 10° to 50°.

14. The method of claim 12, comprising the further step of inducting combustion air via said piston pocket from said supply channel into said transfer channel after the connection of said inlet of said supply channel to said piston pocket.

15. The method of claim 12, comprising the further step of causing said transfer window to remain open longer than said inlet of said supply channel during the upward stroke of said piston

16. The method of claim 12, comprising the further step of supplying an air/fuel mixture to said engine into said crankcase.

17. An internal combustion engine comprising:

a cylinder having a cylinder bore defining a combustion chamber and a cylinder longitudinal axis;

a crankcase connected to said cylinder;

a crankshaft rotatably journalled in said crankcase;

a piston disposed in said cylinder bore so as to move back and forth therein through a piston stroke (h) to drive said crankshaft in rotation and to delimit said combustion chamber;

at least one transfer channel for connecting said crankcase to said combustion chamber in at least one position of said piston;

said transfer channel having a predetermined length and a transfer window opening into said combustion chamber;

said transfer channel being separated from the interior space of said cylinder bore over at least a portion of said length of said transfer channel;

a supply channel having an inlet opening at said cylinder bore;

said piston having at least one piston pocket;

said piston pocket being configured to provide a connection for conducting a fluid between said supply channel and said transfer channel in at least one position of said piston;

said transfer window having a lower edge facing toward said crankcase and said inlet opening having a lower edge facing toward said crankcase;

said piston pocket having a first region passing over said transfer window during said stroke (h);

said piston pocket having a first edge facing toward said combustion chamber and said first edge being a first control edge in said first region;

said piston pocket having a second region passing over said inlet opening of said supply channel during said stroke (h);

said piston pocket having a second edge facing toward said combustion chamber and said second edge being a second control edge in said second region;

at bottom dead center of said piston, said first control edge being at a first distance (a, a') to said lower edge of said transfer window measured parallel to said longitudinal axis;

at said bottom dead center, said second control edge being at a second distance (b, b') to said lower edge of said inlet opening of said supply channel measured parallel to said longitudinal axis; and said first distance (a, a') being less than said second distance (b, b') so as to cause all of said piston pocket to be first connected to said transfer window during said stroke (h) in an upward direction and thereafter to be connected to said inlet opening of said supply channel.

* * * * *